US005767050A

United States Patent [19]

Adamy et al.

[11] Patent Number: 5,767,050

[45] Date of Patent: *Jun. 16, 1998

[54] LIGHT DUTY LIQUID CLEANING COMPOSITIONS COMPRISING PARTIALLY ESTERIFIED POLYHYDRIC ALCOHOL SOLUBILIZING AGENT

[75] Inventors: Steven Adamy, Hamilton; Sat Bedi, Edison; Ammanuel Mehreteab, Piscataway; Barbara Thomas, Princeton, all of N.J.

[73] Assignee: Colgate-Palmolive Co., Piscataway, N.J.

[ * ] Notice: The term of this patent shall not extend beyond the expiration date of Pat. No. 5,523,025.

[21] Appl. No.: 540,636

[22] Filed: Oct. 11, 1995

Related U.S. Application Data

[63] Continuation-in-part of Ser. No. 373,811, Jan. 17, 1995, Pat. No. 5,476,614.

[51] Int. Cl.[6] ..... C11D 1/83; C11D 1/94

[52] U.S. Cl. ..... 510/235; 510/237; 510/422; 510/424; 510/490; 510/497; 510/505; 510/506

[58] Field of Search ..... 510/424, 421, 510/422, 505, 506, 235, 237, 490, 497

[56] References Cited

U.S. PATENT DOCUMENTS

| | | | |
|---|---|---|---|
| 3,720,629 | 3/1973 | Sharman | 510/497 |
| 4,923,635 | 5/1990 | Simion et al. | 510/365 |
| 5,387,375 | 2/1995 | Erilli et al. | 510/424 |
| 5,403,509 | 4/1995 | Pijol et al. | 510/535 |
| 5,415,813 | 5/1995 | Misselyn et al. | 510/365 |
| 5,425,891 | 6/1995 | Pujol et al. | 510/355 |
| 5,476,614 | 12/1995 | Adamy et al. | 510/424 |
| 5,496,492 | 3/1996 | Hamada et al. | 510/159 |
| 5,523,025 | 6/1996 | Erilli | 510/417 |
| 5,549,840 | 8/1996 | Mondin et al. | 510/365 |
| 5,561,106 | 10/1996 | Erilli et al. | 510/109 |
| 5,571,459 | 11/1996 | Thomas et al. | 510/365 |
| 5,593,958 | 1/1997 | Mondin et al. | 510/417 |
| 5,599,785 | 2/1997 | Mondin et al. | 510/417 |

FOREIGN PATENT DOCUMENTS 0586323 3/1994 European Pat. Off. .

*Primary Examiner*—Ardith Hertzog

*Attorney, Agent, or Firm*—Richard Nanfeldt; James M. Serafino

[57] ABSTRACT

A high foaming, surfactant based, light duty, liquid detergent with desirable cleansing properties and mildness to the human skin comprising a biodegradable solubilizing agent, a water soluble, foaming, ethoxylated alkyl ether sulfate anionic surfactant optionally a nonionic surfactant and optionally a water soluble, foaming zwitterionic betaine surfactant.

5 Claims, No Drawings

LIGHT DUTY LIQUID CLEANING COMPOSITIONS COMPRISING PARTIALLY ESTERIFIED POLYHYDRIC ALCOHOL SOLUBILIZING AGENT

RELATED APPLICATION

This application is a continuation in part application of U.S. Ser. No. 08/373,811 filed Jan. 17, 1995 now U.S. Pat. No. 5,476,614.

BACKGROUND OF THE INVENTION

The present invention relates to novel light duty liquid detergent compositions with high foaming properties, containing a biodegradable solubilizing agent, an alkali metal salt of a $C_8$–$C_{18}$ ethoxylated alkyl ether sulfate, optionally one zwitterionic betaine surfactant, optionally a nonionic surfactant, wherein the surfactants and solubilizing agent are dissolved in an aqueous medium.

The prior art is replete with light duty liquid detergent compositions containing nonionic surfactants in combination with anionic and/or betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient. Furthermore, this patent finds heavily foaming detergents undesirable for the purpose of washing socks.

The prior art also discloses detergent compositions containing all nonionic surfactants as shown in U.S. Pat. Nos. 4,154,706 and 4,329,336 wherein the shampoo compositions contain a plurality of particular nonionic surfactants in order to effect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylene polyoxyethylene nonionic detergent, an anionic surfactant, a fatty acid alkanolamide and a polyoxyalkylene glycol fatty ester. But, none of the exemplified compositions contains an active ingredient mixture wherein the nonionic detergent is present in major proportion, probably due to the low foaming properties of the polyoxybutylene polyoxyethylene nonionic detergent.

U.S. Pat. No. 4,595,526 describes a composition comprising a nonionic surfactant, a betaine surfactant, an anionic surfacant and a $C_{12}$–$C_{14}$ fatty acid monethanolamide foam stabilizer.

A number of patents teach esterified ethoxylated glycerol compounds for various applications. These patents are Great Britian 1,453,385; Japan 59-1600 and Japan 58-206693 and European Patent Application 0586,323A1. These publications fail to appreciate that a mixture of esterified ethoxylated glycerol and nonesterified ethoxylated glycerol, when used in a hard surface cleaning composition, functions as a grease release agent.

However, none of the above-cited patents discloses a high foaming, liquid detergent composition containing a biodegradable solubilizing agent an alkali metal salt of $C_8$–$C_{18}$ ethoxylated alkyl ether sulfate surfactant, optionally a nonionic surfactant and optionally at least one supplementary foaming zwitterionic surfactant selected from betaine type surfactants.

SUMMARY OF THE INVENTION

The present invention provides an improved, clear light duty liquid cleaning composition having improved interfacial tension which improves cleaning hard surfaces such as dishes, plastic, vitreous and metal surfaces having a shiny finish. The light duty liquid compositions of the instant invention can be generally described as comprising approximately by weight:

(a) 1% to 14% of an alkali metal ammonium or alkali earth metal salt of a $C_8$–$C_{18}$ ethoxylated alkyl ether sulfate surfactant;

(b) about 10 to about 30% of a solubilizing agent which is an ethoxylated polyhydric alcohol which is partially esterified;

(c) 0 to 6% of a nonionic surfactant;

(d) 0 to 10% of a zwitterionic surfactant such as a betaine; and (e) the balance being water, wherein the composition has a Brookfield viscosity at 25° C. at 30 rpms using a #2 spindle of about 20 to 500 cps, more preferably about 200 to 450 cps, a pH of about 5 to about 7, and a light transmission of at least about 95%, more preferably at about 98%.

An object of this invention is to provide novel, liquid detergent with desirable high foaming and cleaning properties which is mild to the human skin.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein the novel, high foaming, light duty liquid detergent of this invention comprises a biodegradable solubilizing agent, an alkali metal salt of an ethoxylated alkyl ether sulfate optionally a nonionic surfactant and at least one foaming water soluble, zwitterionic surfactant selected from the class of betaines, wherein the surfactants and solubilizing agent are dissolved in an aqueous vehicle.

DETAILED DESCRIPTION OF THE INVENTION

The present invention provides an improved, clear light duty liquid cleaning composition having improved interfacial tension which improves cleaning hard surfaces such as dishes, plastic, vitreous and metal surfaces having a shiny finish.

The light duty liquid compositions of the instant invention can be generally described as comprising approximately by weight:

(a) 1% to 14% of an alkali metal, alkali earth metal or ammonium salt of a $C_8$–$C_{18}$ ethoxylated alkyl ether sulfate surfactant;

(b) about 10 to about 30% of a solubilizing agent which is an ethoxylated polyhydric alcohol which is partially esterified;

(c) 1% to 6% of a nonionic surfactant;

(d) 1% to 10% of a zwitterionic surfactant such as a betaine;

(e) 0 to 8% of an aliphatic alcohol having about 8 to about 16 carbon atoms such as 1-undecanol; and (f) the balance being water, wherein the composition has a Brookfield viscosity at 25° C. at 30 rpms using a #2 spindle of about 20 to 500 cps, more preferably about 200 to 450 cps, a pH of about 5 to about 7, a light transmission of at least about 95%, more preferably at about 98%, and a minimum final foam volume as measured by the inversion foam test at 25° C. of at least 200 mls, more preferably 250 mls and a foam performance ratings as measured by the Shell Foam Longevity Test of at least about 80, more preferably at least about 85 and most preferably at least about 90. The Inversion Foam Test consists of 100 g detergent solution at 0.05% in 150 ppm 2:1 Ca:Mg hardness water placed in a stoppered 500 ml grad. cylinder. The cylinders are inverted 40 times at 30 rpm. After 30 sec., the foam level is read in ml. After the foam level is read, a sugar cube with 0.01 g of greasy starchy soil, is added to each cylinder and they are then inverted again 40 times at 30 rpm. The soil consists of 15 wt. % Crisco shortening, 15 wt. % olive oil, 15 wt. % potato powder, 30 wt. % whole milk and 25 wt. % deionized water. After 30 sec. the final foam level is read. Each sample is run in triplicate. The 100 ml of solution is subtracted and the trials are averaged. The Shell Foam Longevity Test is a standard procedure as described by Blanco, R., Bouman, J. T., and Kok, R., Performance Testing of Dishwashing Liquids Development of a Foam Titration Method, Shell Chemical Company Technical Bulletin, SC:967–87 (January 1987). In this test, the performance of commercial Palmolive Dishwashing liquid (Pol C manufactured by Colgate-Palmolive Company) is defined as 100. The foam values are measured as a ratio of test sample to Pol C.

The partially esterified ethoxylated polyhydric alcohol such as an ethoxylated glycerol type solubilizing agents of the instant invention are a mixture of nonesterified species, partially esterified species and fully esterified species as depicted by the following Formulas (I) and (II):

Formula (I)

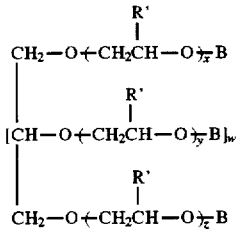

Formula (II)

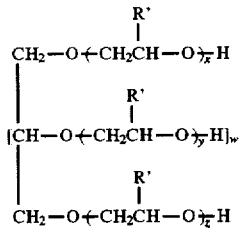

wherein w equals one to four, most preferably one. B is selected from the group consisting of hydrogen or a group represented by:

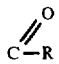

wherein R is selected from the group consisting of alkyl group having about 6 to 22 carbon atoms, more preferably about 11 to about 15 carbon atoms and alkenyl groups having about 6 to 22 carbon atoms, more preferably about 11 to 15 carbon atoms, wherein a hydrogenated tallow alkyl chain or a coco alkyl chain is most preferred, wherein at least one of the B groups is represented by said

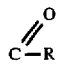

and R' is selected from the group consisting of hydrogen and methyl groups; x, y and z have a value between 0 and 60, more preferably 0 to 40, provided that (x+y+z) equals about 2 to about 100, preferably 4 to about 24 and most preferably about 4 to 19, wherein in Formula (I) the weight ratio of monoester/diester/triester is 40 to 90/5 to 35/1 to 20, more preferably 50 to 90/9 to 32/1 to 12, wherein the weight ratio of Formula (I) to Formula (II) is a value between 3 to about 0.33, preferably 1.5 to about 0.4.

The ethoxylated glycerol type solubilizing agents used in the instant composition are manufactured by the Kao Corporation and sold under the trade name Levenol such as Levenol F-200 which has an average EO of 6 and a molar ratio of coco fatty acid to glycerol of 0.55 or Levenol V501/2 which has an average EO of 17 and a molar ratio of tallow fatty acid to glycerol of 1.0. The ethoxylated glycerol type solubilizing agent has a molecular weight of about 400 to about 1600, and a pH (50 grams/liter of water) of about 5–7. The Levenol solubilizing agents are substantially nonirritant to human skin and have a primary biodegradability higher than 90% as measured by the Wickbold method Bias-7d.

Two examples of the Levenol solubilizing agents are the Levenol V-501/2 which has 17 ethoxylated groups and is derived from tallow fatty acid with a fatty acid to glycerol ratio of 1.0 and a molecular weight of about 1465 and Levenol F-200 has 6 ethoxylated groups and is derived from coco fatty acid with a fatty acid to glycerol ratio of 0.55. Both Levenol F-200 and Levenol V-501/2 are composed of a mixture of Formula (I) and Formula (II). The Levenol solubilizing agent have ecoxicity values of algae growth inhibition >100 mg/liter; acute toxicity for Daphniae >100 mg/liter and acute fish toxicity >100 mg/liter. The Levenol solubilizing agents have a ready biodegradability higher than 60% which is the minimum required value according to OECD 301B measurement to be acceptably biodegradable.

Other polyesterified nonionic solubilizing agents also useful in the instant compositions are Crovol PK-40 and Crovol PK-70 manufactured by Croda GMBH of the Netherlands. Crovol PK-40 is a polyoxyethylene (12) Palm Kernel Glyceride which has 12 EO groups. Crovol PK-70 which is preferred is a polyoxyethylene (45) Palm Kernel Glyceride have 45 EO groups.

In the instant compositions the nonionic ethoxylated glycerol type solubilzing agent or the polyesterified nonionic solubilizing agent will be present in admixture with the anionic detergent. The proportion of the ethoxylated glycerol type solubiling agent or the polyesterified nonionic solubilizing agent based upon the weight of the light duty liquid composition will be 10 wt. % to 30 wt. %, more preferably 12 wt. % to 26 wt. %, most preferably about 14 wt. % to 22 wt. %.

The ethoxylated alkyl ether sulfate (AEOS.xEO) used in the instant compositions at a concentration of about 1 wt. % to about 14 wt. %, more preferably about 2 wt. % to about 12 wt. % is depicted by the formula: $[R\text{-}(OCH_2\text{—}CH_2)x\ OSO_3]_yM$ wherein x is 1 to 22, more preferably 1 to 10, y is 1 or greater, and R is an alkyl group having 8 to 18 carbon atoms and more preferably 12 to 15 carbon atoms and natural cuts for example $C_{12\text{-}14}$, $C_{12\text{-}13}$ and $C_{12\text{-}15}$ and M is an ammonium, alkali, or alkali earth metal cation such as sodium, ammonium or magnesium. The ethoxylated alkyl ether sulfates may be made by sulfating the condensation product of ethylene oxide and $C_{8\text{-}18}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether sulfates contain 10 to 16 carbon atoms in the alcohols and in the alkyl groups thereof. Ethoxylated $C_{8\text{-}18}$ alkylphenyl ether sulfates containing from 2 to 6 moles of ethylene oxide in the molecule also are suitable for use in the inventive compositions.

The at least one water-soluble zwitterionic surfactant, which is optionally used the present liquid detergent composition provides good foaming properties and mildness to the present liquid detergent. The zwitterionic surfactant is a water soluble betaine having the general formula:

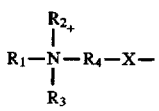

wherein X- is selected from the group consisting of $CO_2^-$ and $SO_3^-$ and $R_1$ is an alkyl group having 10 to 20 carbon atoms, preferably 12 to 16 carbon atoms, or the amido radical

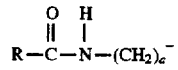

wherein R is an alkyl group having 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N, N-dimethyl-ammonia) acetate, coco dimethyl betaine or 2-(N-coco N, N-dimethylammonia) acetate, myristyl dimethyl betaine, palmityl dimethyl betaine, lauryl dimethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine in the formula containing the polyesterified surfactant and is present at a concentration of about 0 wt. % to 10 wt. %, more preferably 1 wt. % to about 10 wt. %, most preferably about 2 wt. % to about 8 wt. %.

The instant composition can also optionally contain a nonionic surfactant at a concentration of 0 to about 6% by weight, more preferably about 1 wt. % to 6 wt. %, more preferably 2 wt. % to 5 wt. %.

The nonionic surfactants optionally utilized in this invention are commercially well known and include a highly hydrophobic ethoxylated nonionic surfactant having an HLB of 12 or less. The ethoxylated nonionic has the formula:

$$R\text{—}(OCH_2CH_2)_x\text{—}OH$$

wherein x is 1 to 5 and R is an alkyl group having about 8 to about 16 carbon atoms. The preferred aliphatic alcohol having about 8 to about 16 carbon atoms is 1-undecanol.

The particular combinations of surfactants provides a surfactant system which coacts with the biodegradable solubilizing agent to produce a liquid detergent composition with desirable foaming, foam stability, detersive properties and mildness to human skin. Surprisingly, the resultant homogeneous liquid detergent exhibits the same or better foam performance, both as to initial foam volume and stability of foam in the presence of soils, and cleaning efficacy as an anionic based light duty liquid detergent (LDLD).

The ingredients discussed above are solubilized in an aqueous medium comprising water and optionally, sodium xylene sulfonate or sodium cumene sulfonate which are included in order to control the viscosity of the liquid composition and to control low temperature cloud clear properties. Usually, it is desirable to maintain clarity to a temperature in the range of 5° C. to 10° C. Therefore, the proportion of sodium xylene sulfonate or sodium cumene sulfonate generally will be from about 0% to 15%, preferably 1% to 12%, most preferably 2% to 8%, by weight of the detergent composition. Sodium cumene sulfonate is preferred. Inorganic salts such as sodium sulfate, magnesium sulfate, sodium chloride and sodium citrate can be added at concentrations of 0.1 to 15 wt. % to modify the cloud point of the nonionic surfactant and thereby control the haze of the resultant solution. Other ingredients which have been added to the compositions at concentrations of about 0.1 to 4.0 wt. percent are perfumes, sodium bisulfite, ETDA, isoethanoeic and proteins such as lexeine protein.

In addition to the previously mentioned essential and optional constituents of the light duty detergent, one may also employ normal and conventional adjuvants, provided they do not adversely affect the properties of the detergent. Thus, there may be used various coloring agents and perfumes; ultraviolet light absorbers such as the Uvinuls, which are products of BASF Corporation; sequestering agents such as ethylene diamine tetraacetates; magnesium sulfate heptahydrate; pearlescing agents and opacifiers; pH modifiers; etc. The proportion of such adjuvant materials, in total will normally be about 0.1 to 15% of weight of the detergent composition, and the percentages of most of such individual components will be a maximum of 5% by weight and preferably less than about 2% by weight. Sodium formate can be included in the formula as a perservative at a concentration of 0.1 to 4.0%. Sodium bisulfite can be used as a color stabilizer at a concentration of about 0.01 to 0.2 wt. %. Typical perservatives are dibromodicyano-butane, citric acid, benzylic alcohol and poly (hexamethylene-biguamide) hydrochloride and mixtures thereof.

In addition to the above-described ingredients required for the formation of the light-duty liquid composition, the compositions of this invention may possibly contain one or more additional ingredients which serve to improve overall product performance.

One such ingredient is an inorganic or organic salt of oxide of a multivalent metal cation, particularly Mg++. The metal salt or oxide provides several benefits including improved cleaning performance in dilute usage, particularly in soft water areas. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level. Thus, depending on such factors as the nature of the surfactants and so on, as well as the availability and cost factors, other suitable polyvalent metal ions include aluminum, copper, nickel, iron, calcium, etc. can be employed. It has also been found that the aluminum salts work best at pH below 5 or when a low level, for example about 1 weight percent, of citric acid is added to the composition which is designed to have a neutral pH. Alternatively, the aluminum salt can be directly added as the citrate in such case. As the salt, the same general classes of anionis as mentioned for the magnesium salts can be used, such as halide (e.g., bromide, chloride), sulfate, nitrate, hydroxide, oxide, acetate, propionate, etc.

Preferably, in the dilute compositions the metal compound is added to the composition in an amount sufficient to provide at least a stoichiometric equivalent between the anionic surfactant and the multivalent metal cation. Thus, the proportion of the multivalent salt generally will be selected so that one equivalent of compound will neutralize from 0.1 to 1.5 equivalents, preferably 0.9 to 1.4 equivalents, of the acid form of the anionic detergent.

The present light duty liquid detergents such as dishwashing liquids are readily made by simple mixing methods from readily available components which, on storage, do not adversely affect the entire composition. However, it is preferred that the biodegradable solubilizing agent be mixed with the a $C_1$–$C_3$ substituted benzene sulfonate such as sodium xylene sulfonate or sodium cumene sulfonate, at a concentration of about 1 wt. % to 15 wt. %, if present, prior to the addition of the water to prevent possible gelation. The surfactant system is prepared by sequentially adding with agitation the ethoxylated alkyl ether surfactant and optionally the betaine surfactant and optionally the nonionic surfactant to the aqueous solution of the biodegradable solubilizing agent which has been previously mixed with a sodium cumene sulfonate sodium xylene sulfonate to assist in solubilizing said surfactants, and then adding with agitation the formula amount of water to form an aqueous solution of the surfactant system. The use of mild heating (up to 100° C.) assists in the solubilization of the surfactants. The viscosities are adjustable by changing the total percentage of active ingredients. No polymeric or clay, thickening agent is added. In all such cases the product made will be pourable from a relatively narrow mouth bottle (1.5 cm diameter) or opening, and the viscosity of the detergent formulation will not be so low as to be like water. The viscosity of the cleaning composition desirably will be at least 100 centipoises (cps) at room temperature, but may be up to 1,000 centipoises as measured with a Brookfield Viscometer using a number 30 spindle rotating at 10 rpms. Its viscosity may approximate those of commercially acceptable detergents now on the market. The cleaning composition's viscosity and the cleaning composition itself remain stable on storage for lengthy periods of time, without color changes or settling out of any insoluble materials. The pH of this formation is substantially neutral to skin, e.g., 4.5 to 8 and preferably 5.0 to 7.0.

These products have unexpectedly desirable properties. For example, the foam quality and detersive property is equal to or better than standard light duty liquid compositions.

The instant formulas explicitly exclude, sulfonate surfactants, alkali metal silicates and alkali metal builders such as alkali metal polyphosphates, alkali metal carbonates, alkali metal phosphonates and alkali metal citrates because these materials, if builders are used in the instant composition, they would cause the composition to have a high pH as well as leaving a residue on the surface being cleaned.

The following examples are merely illustrative of the invention and are not to be construed as limiting thereof.

DESCRIPTION OF THE PREFERRED EMBODIMENTS

EXAMPLE 1

The following formulas were prepared at room temperature by simple liquid mixing procedures as previously described

| | A | B | C | D | E | Commercial Palmolive Skin Sensitive |
|---|---|---|---|---|---|---|
| Levenol V-501/2 | | | | 15.0 | 11 | |
| Levenol F200 | 20 | 20 | 20 | | | |
| Sodium laureth 1-sulfate sodium | 4.5 | 4.5 | 4.5 | | | |
| Ammonium AEOS(3EO) | | | | 5.0 | | |
| MgAEOS(3EO) | | | | | 9.0 | |
| Cocoamide propyl betaine | 5 | 5 | 5 | | | |
| Neodol 1-3 | 3 | | | | | |

-continued

| | A | B | C | D | E | Commercial Palmolive Skin Sensitive |
|---|---|---|---|---|---|---|
| Neodol 1-6 | | 3 | | | | |
| Neodol 1-9 | | | 3 | | | |
| $MgSO_4.7H_2O$ | 8 | 8 | 8 | | | |
| Water | Bal. | Bal. | Bal. | Bal. | Bal. | |
| Appearance | Clear | Clear | Clear | Clear | Clear | Clear |
| % soil cleaning after seven minutes | 35 | 11 | 5 | | | 6 |

Soil Preparation. The soil was prepared one day in advance of performing the test. A 1/1 mixture (by weight) of Armour Lard and Crisco was melted in a vessel which was placed in a water bath between 60° and 70° C. Once melted, the mixture was stirred for about five minutes. The vessel was then removed from the bath. The mixture was allowed to cool to room temperature by letting it sit undisturbed until it reached room temperature. The then solid mixture was kept overnight in a refrigerator at about 0° C. The next day, the soil was removed from the refrigerator, allowed to come to room temperature, and then applied to plastic (PVC) slides.

Slide Preparation and Performance. About 0.24 g of the 1/1 mixture of lard and Crisco was evenly spread on a plastic slide over both sides using a serrated knife. The weight of soil was noted, and the slide was placed in 120 ml of a stirred test solution in a 150 ml beaker. The slide was placed in the beaker so that it lay diagonally. Test solutions were made with deionized water and the formula concentration of each solution was 1.0% (by weight). The solution was stirred at 250 rpm with a 1"×5/16" stirring bar for 7 minutes. The stirring bar was placed slightly off-center with respect to the center of the beaker. The slide was then removed, dipped twice in deionized water, and allowed to dry in a desiccator overnight. Finally, the slide was weighed to determine the percentage of soil removed. All tests were performed at room temperature.

The inventive compositions all perform equally or superior to the commercial product. However, employing a hydrophobic ethoxylated nonionic surfactant (Neodol 1–3) along with the mild Levenol gives superior performance over formulas with the more hydrophilic variants (e.g. Neodol 1–9). Addition of the highly hydrophobic nonionic allows use of a large quantity of surfactant which is not classified as a skin or eye irritant. The final formulation would therefore also not be classified as an irritant, but would display a superior efficacy over the prior art.

What is claimed is:

1. A detergent cleaning composition comprising:

(a) about 10 wt. % to about 30 wt. % of a mixture of

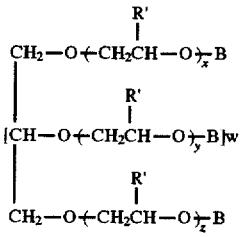

(I)

and

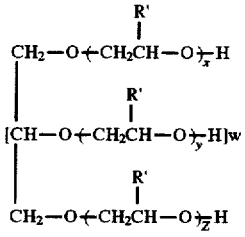

(II)

wherein w equals one to four, B is selected from the group consisting of hydrogen and a group represented by:

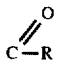

wherein R is selected from the group consisting of alkyl group having about 6 to 22 carbon atoms, and alkenyl groups having about 6 to 22 carbon atoms, wherein at least one of the B groups is represented by said

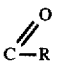

R' is selected from the group consisting of hydrogen and methyl groups; x, y and z have a value between 0 and 60, provided that (x+y+z) equals about 2 to about 100, wherein in Formula (I) the weight ratio of monoester/diester/triester is 40 to 90/5 to 35/1 to 20, wherein the weight ratio of Formula (I) and Formula (II) is a value between 3 and about 0.33; and (b) about 0 wt. % to about 10 wt. % of a betaine surfactant;

(c) about 1 wt. % to about 14 wt. % of an ammonium, alkali or alkali metal salt of a $C_8$–$C_{18}$ ethoxylated alkyl ether sulfate surfactant;

(d) about 0 wt. % to about 6 wt. % of an ethoxylated nonionic surfactant having the formula R" $(OCH_2CH_2)q$ OH wherein q is 1 to 5 and R" is an alkyl group having about 8 to 16 carbon atoms; and (e) the balance being water.

2. The composition of claim 1 which further contains a salt of a multivalent metal cation.

3. The detergent cleaning composition of claim 7 wherein the multivalent metal cation is magnesium or aluminum.

4. The detergent cleaning composition of claim 3 wherein said salt of said multivalent metal cation is magnesium sulfate.

5. The detergent cleaning composition of claim 2 wherein said composition contains 0.9 to 1.4 equivalents of said cation per equivalent of said $C_{8-18}$ ethoxylated alkyl ether sulfate surfactant.

* * * * *